United States Patent [19]

Evans

[11] 4,048,059

[45] Sept. 13, 1977

[54] PALLET RACK AND DECKING COMBINATION

[75] Inventor: Robert J. Evans, Aurora, Ill.

[73] Assignee: Aurora Equipment Company, Aurora, Ill.

[21] Appl. No.: 634,433

[22] Filed: Nov. 24, 1975

[51] Int. Cl.[2] ..... A47B 47/00

[52] U.S. Cl. ..... 108/155; 52/283; 52/578; 52/285; 108/111; 108/159; 211/187; 403/405; 403/341; 403/230

[58] Field of Search ..... 108/90, 97, 111, 155, 108/159; 248/250; 211/187; 52/489, 760

[56] References Cited

U.S. PATENT DOCUMENTS

| | | | |
|---|---|---|---|
| 1,764,413 | 6/1930 | Nielsen | 52/760 X |
| 2,918,176 | 12/1959 | Bell et al. | 211/187 X |
| 2,940,605 | 6/1960 | Logie et al. | 211/187 |
| 2,964,807 | 12/1960 | Kennedy | 52/760 X |
| 3,072,262 | 1/1963 | Cassel | 211/187 X |
| 3,094,848 | 6/1963 | Albrecht | 108/159 X |
| 3,097,822 | 7/1963 | Attwood | 248/250 |
| 3,224,533 | 12/1965 | Nystrom | 52/760 |
| 3,463,325 | 8/1969 | Zagotta et al. | 211/187 X |
| 3,587,483 | 6/1971 | Konstant | 211/187 X |
| 3,695,456 | 10/1972 | Lewis | 52/760 X |
| 3,814,034 | 6/1974 | Seiz | 211/187 X |
| 3,846,944 | 11/1974 | Lambert | 211/187 X |

FOREIGN PATENT DOCUMENTS

| | | | |
|---|---|---|---|
| 1,012,396 | 7/1952 | France | 248/250 |

*Primary Examiner*—Roy D. Frazier
*Assistant Examiner*—William E. Lyddane
*Attorney, Agent, or Firm*—Hill, Gross, Simpson, Van Santen, Steadman, Chiara & Simpson

[57] ABSTRACT

The present invention is concerned with a new type of pallet rack having decking panel retainers for positively securing the pallet rack structure to the pallet rack in unitary assembly so that the pallet rack structure cannot become accidentally disengaged from the supporting beams.

3 Claims, 10 Drawing Figures

PALLET RACK AND DECKING COMBINATION

BACKGROUND OF THE INVENTION

1. Field of the Invention

The present invention relates to a pallet rack and more particularly to new and improved means for securing a decking panel structure on a pallet rack.

2. Prior Art

In the past, it has been found that where a decking panel structure has been installed in a pallet rack, that there is some tendency for the beams supporting the pallet rack structure to bow in such a way that the beams tend to move apart. Where the load is heavy enough, the decking panel structure comprising the wood or steel decking tends to drop off of the beams to a lower level of the rack.

It is, therefore, an important object of this invention to provide a pallet rack structure with new and improved means for preventing a decking panel structure from falling off of the beams by preventing the beams from moving outwardly in a direction apart from one another.

Another important object of the present invention is to provide a decking panel retainer that is particularly adapted for securing a decking panel structure of different types to the beams of the pallet rack.

A further object of this invention is to provide new decking panel retainers that are particularly adapted for securing different types of decking panel structure to the beams of a pallet rack in order to prevent the beams from moving apart when the decking panel structure is heavily loaded.

A still further object of the invention is to provide new and improved decking panel retainers suitable for attaching decking panel comprised either of wooden planks or sheet metal decking or plywood sheets to the beams of a pallet rack in order to provide positive locks to prevent accidental dislodgement of the decking panel due to being heavily loaded.

The invention will be further described with reference to the accompanying drawings, which illustrate various embodiments of the invention, which are given by way of example only and not by way of limitation.

DESCRIPTION OF PREFERRED EMBODIMENTS

Figure 1:
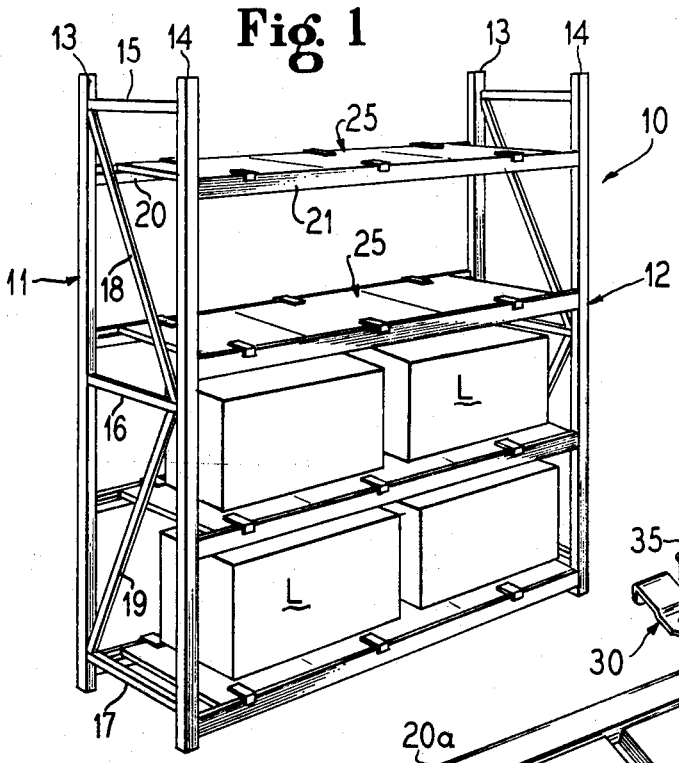
FIG. 1 is a perspective view of a pallet rack embodying features of my invention.

The reference numeral 10 indicates generally a pallet rack which is comprised of horizontally spaced upright sections 11 and 12. The sections 11 and 12 are essentially identical in construction and a description of one would suffice for both. In this respect, the section 11 is comprised of a pair of uprights 13 and 14. The uprights 13 and 14 are suitably secured to one another by means of horizontal arms 15, 16 and 17. Truss arms 18 and 19 extend diagonally between the arms 15, 16 and 17 and between the uprights 13 and 14 and all of these parts are rigidly secured by suitable means to provide a reinforced upright section. Suitable fasteners can be provided for assembling the components of each upright section together.

In order to carry horizontally spaced loads on the pallet rack 10, the rack is provided with horizontally spaced pairs of horizontal beams 20 and 21. The beams 20 and 21 are all of the same construction and are adapted to be suitably secured by removable fasteners (not shown) at opposite ends to the associated uprights provided on the upright sections 11 and 12 at opposite ends of the beams. The spacing between the various pairs of beams as seen in FIG. 1 can be adjusted so that different sized loads L can be mounted upon the rack as may be desired.

Figure 2:
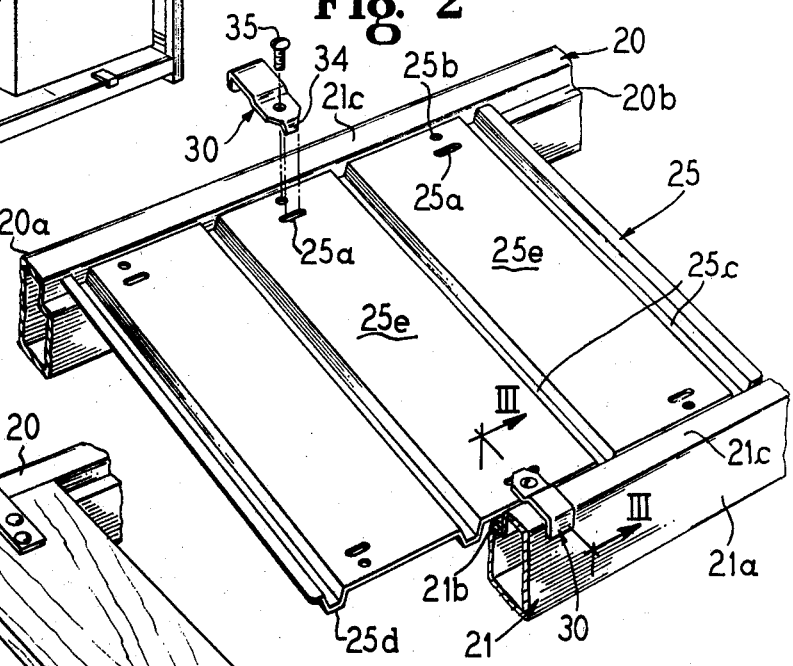
FIG. 2 is an enlarged fragmentary perspective view of a portion of a pallet rack shown in FIG. 1 with one retainer and its fastener shown in an exploded position and with other parts shown in section for illustrating various details of my invention.

As was previously noted, the present application discloses four different types of clips as separately illustrated in FIGS. 6, 7, 8, and 9 and identified by reference numerals 30, 40, 50, and 60. Each of these clips is attached to be used with a pallet rack of the type already described herein and as illustrated at 10 in FIG. 1. These clips are adapted to co-act with different types of decking panel structures. In this application, two types of decking panel structures have been illustrated, including a ribbed sheet metal decking structure 25 (see FIGS. 2 and 3) and a decking panel structure comprised of a series of planks 26 (see FIGS. 4 and 5) disposed in side by side relation. The clips 40 and 50 are particularly suited for securing a decking panel structure where it is comprised of a series of planks 26 disposed in side by side relation. The sheet metal decking panel structure 25 is secured in position on the rack by means of the clips 30 and 60.

With respect to the clips 30, it will be seen that each clip has a horizontal leg portion 31 and a downwardly hooked end portion 32' that is attached to co-act with the vertical beam surfaces **21*a* when mounted on the rack 10. The clip 30 is further provided with a mitered or downwardly angled step down leg portion 32 which merges into a frusto-conical leg portion 33 and terminates in a second hooked end 34. The hooked end 34 has a reduced width as compared to the opposite hooked end 32' to facilitate engagement with slots 25*a* in the decking structure 25. When the clips 30 are assembled with a sheet metal decking structure as shown at 25, the sheet metal decking structure can either have prepunched slots 25*a* and fastener holes 25*b* or these can be drilled at the job site. When the ribbed sheet metal panel structure is mounted on the rack and supported by beam ledges 20b and 21b, the ribs 25c provide supporting surfaces 25d which are engaged with the beam ledges 20b and 21b. With the installation of the sheet metal decking panel onto the ledges, the clips 30 can then be installed. Each clip can have its hooked end 34 aligned with the slots 25a and then the hooked end can be caused to be engaged in the slot. Bolt type fasteners 35 are provided for permanently attaching the clip 30 with the sheet metal decking panel structure 25. With the attachment of the fastener 35 to the decking panel structure, the hooked end 32' of the clip is engaged against vertical front and rear surfaces 20a and 21a** of the beams to retain the decking panel structure in unitary assembly with the beams.

Figure 3:
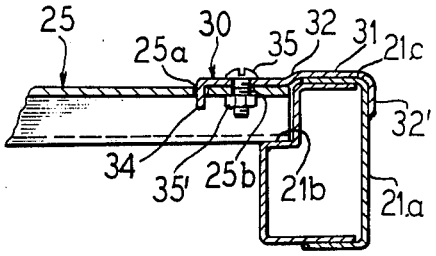
FIG. 3 is an enlarged fragmentary cross-sectional view taken on the line III—III looking in the direction indicated by the arrows as seen in FIG. 2.

While I have illustrated the clips 30 as being particularly suited for attaching a sheet metal type decking panel structure to the beams 20 and 21, it should be appreciated that the same clips could be used to secure plywood sheets to the beams 20 and 21 if plywood sheets were substituted in place of the sheet metal ribbed decking panel structure. It will further be noted that where the clips 30 are installed that the clip portion 31 (FIG. 3) is adapted to engage atop a horizontal beam surface 21c. It will further be seen that the step down clip portion 32 is angled so as to bridge the vertical gap between the top surface of the sheet metal decking panel structure and a top surface of the beam as shown at 21c. A nut as indicated at 35' in FIG. 3 is provided to co-act with threaded bolt 35 to secure the clip 30 to the sheet metal decking structure 25.

Figure 4:
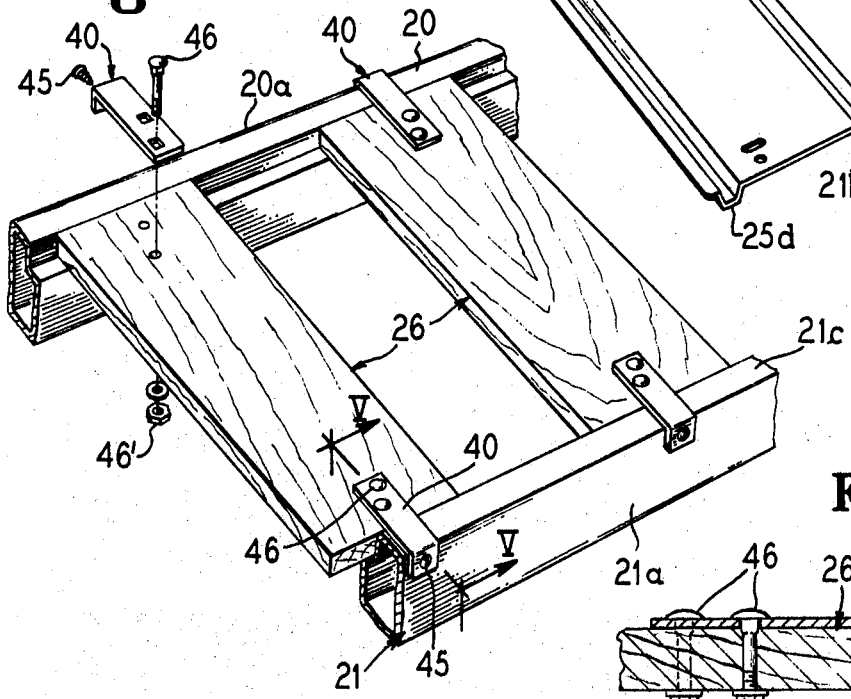
FIG. 4 is an enlarged fragmentary view similar to FIG. 2 only illustrating a modification of my invention.
Figure 5:
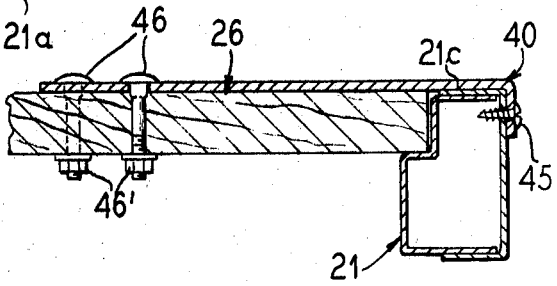
FIG. 5 is an enlarged cross-sectional view taken substantially on the line V—V looking in the direction indicated by the arrows as seen in FIG. 4.
Figure 6:
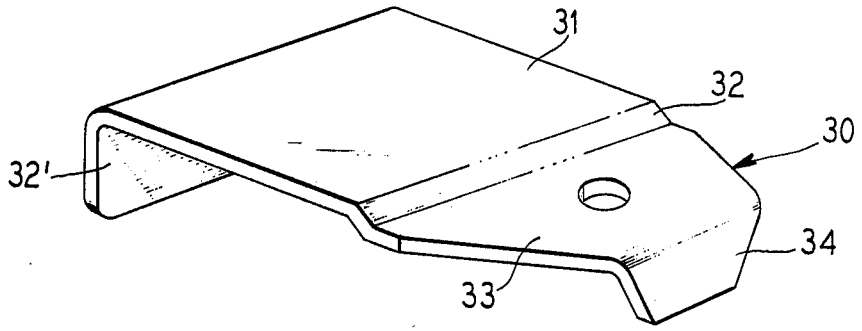
FIG. 6 is an enlarged perspective view of a decking panel retainer of the type shown in FIG. 2.
Figure 7:
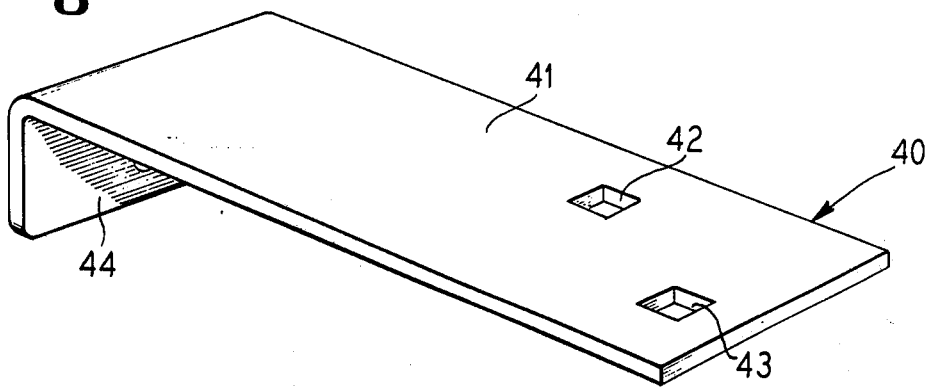
FIG. 7 is an enlarged perspective view of a decking panel retainer of the type shown in FIG. 4.

Turning now to the clip 40 shown in FIG. 7, it will be observed that it includes the elongated clip leg portion 41 having a pair of slots 42 and 43 adjacent to one end. At the opposite end of the leg portion 41 is a downwardly turned hooked end 44 which is attached to co-act with the beams 20 and 21 in the same manner as the turned down hooked end 32' shown in FIG. 3 on clip 30. As will be seen in FIG. 4, the clip 40 is adapted to be secured with the beams 20 and 21 by means of sheet metal screws 45 and by means of a bolt type fastener 46 having nuts 46' for securing the bolt with elongated clip leg 41 and with the associated wooden plank 26. The bolts are adapted to project through slots 42 and 43 in the leg portion 41 of the clip 40 and then through the associated plank 26 whereupon the nuts 46' can be threaded onto the threads of the bolt. Washers can be used as is illustrated to provide a firm connection (FIG. 4). Thus, it will be seen the fasteners 40 are adapted to positively lock opposite ends of the wooden planks 26 in permanent attachment with the beams 20 and 21.

Figure 8:
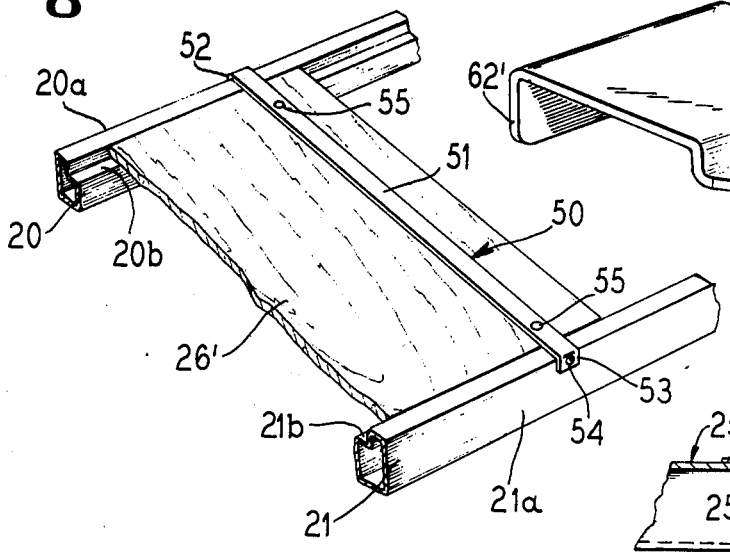
FIG. 8 is an enlarged fragmentary perspective view similar to FIGS. 2 and 4 only showing a further modification of my invention.

Turning now to still another embodiment, attention is directed to FIG. 8 where the clip 50 is illustrated for securing wooden planks 26' onto beam ledges 20b and 21b. The clip 50 has an intermediate leg portion 51 with a pair of hooked ends 52 and 53. The hooked ends 52 and 53 are adapted to be secured to outside surfaces of the beams as indicated at 20a and 21a by sheet metal screws 54. The intermediate leg portion 51 is also adapted to be secured by means of fasteners 55—55 to secure the wooden planks in unitary assembly with the intermediate leg portion 51 of the clip 50.

Figure 9:
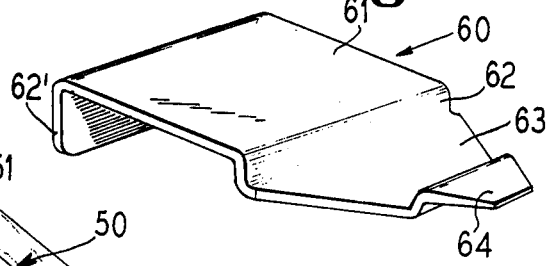
FIG. 9 is an enlarged perspective view of an alternate embodiment of the decking panel retainer of FIG. 6.
Figure 10:
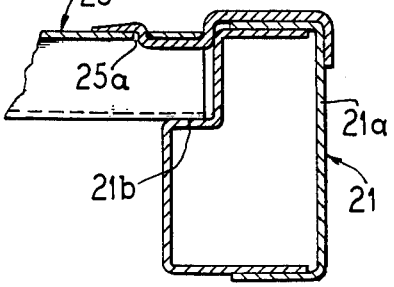
FIG. 10 is an enlarged cross-sectional view of the decking panel retainer of FIG. 9 in locked position on a portion of the pallet rack of FIG. 2.

FIGS. 9 and 10 disclose an embodiment of a retainer clip 60 which does not require fastening hardware when used with the sheet metal decking structure, 25. With respect to clip 60, it will be seen that each clip has a horizontal length portion 61 and a downwardly hook end portion 62', it is attached to co-act with the vertical beam surfaces 21a, mounted on the rack 10. The clip 60 is further provided with a mitered or downwardly angled step down leg portion 62 which merges into a frusto-conical right portion 63 and terminates in the second hooked end 64. The hooked end 64 has a reduced width as compared to the opposite hooked end 62' to facilitate engagement with slots 25a in the decking structure, 25. This clip requires no hardware. When the clips 60 are assembled with the sheet metal decking structure as shown at 25, the sheet metal decking structure can either have free punched slots 25a or these can be cut on the job site. When the rib sheet panel structure is mounted on the rack and supported by beam ledges 20b and 21b, the ribs 25c provide supporting surfaces which are engaged with the beam ledges 20b and 21b. With the installation of the sheet metal decking panel onto the ledges the clip 60 can then be installed. Each clip can have its hooked ends 64 aligned with the slots 25a and then the hooked end 64 can be engaged in the slot 25a.

In summation, it will thus be seen that in all forms the clips 30, 40, 50 and 60 are comprised of sheet metal such as sheet steel and are of a uniform cross-section thickness along the length thereof. Also, with respect to the fasteners 35, 46 and 55, it will be seen that all of them are centered with respect to the decking section which in one instance may comprise the wooden panel 26 and in another instance may comprise the metal sections 25e that are separated by the ribs 25c. In this manner, the clip retainers can more effectively act to secure the decking panel structure in a unitary fixed position on the beams 20 and 21.

I claim as my invention:

1. In combination, a pallet rack comprising a pair of spaced uprights, spaced beams positioned between the spaced uprights with each beam having its opposite ends mounted on the spaced uprights, the beams being arranged in pairs with each pair disposed in a common horizontal plane, each beam having beam ledges, a decking panel structure having edges carried by the beam ledges, said edges abutting against a vertical wall portion of each beam ledge, a top surface of said decking panel having slots adjacent said edges, decking panel retainer means for securing the decking panel structure to said beams, said retainer means retainingly securing said associated pair of beams against bowing, including an angular clip having a generally horizontal leg portion secured to a top surface of the decking panel structure and also resting on a top surface of said beams and a first down turned hooked end engaging a rear side of the associated beam, and fastener means securing each of said angular clips to said decking panel structure to prevent the decking panel structure from being displaced from said beams and dropping vertically free of the associated spaced beams, said fastener means comprising a second hooked end on said horizontal leg portion positioned in said slot and a bolt means compressing together said retainer horizontal leg portion and top surface of said panel structure.

2. The combination of claim 1 in which said retainer means down turned hooked end connects to said horizontal leg portion by a downwardly angled step-down leg portion means for engagement with an edge formed between the top side of the beam and said beam ledges.

3. In combination, a pallet rack comprising a pair of spaced uprights;

spaced beams positioned between the spaced uprights with each beam having its opposite ends mounted on the spaced uprights, the beams being arranged in pairs with each pair disposed in a common horizontal plane, each beam having beam ledges;

a decking panel structure carried by the beam ledges, a top surface of said decking panel structure having slots near side edges adjacent the beam ledges;

decking panel retainer means for securing the decking panel structure to said beams;

said retainer means retainingly securing said associated pair of beams against bowing, including an angular clip having a generally horizontal leg portion secured to the decking panel structure and also resting on a top side of said beams and a down turned hooked end engaging a rear side of the associated beam; and said retainer means comprising a second hooked end on each of said retainer means opposite said down turned hooked end, said second hooked end protruding upward through each of said slots, said retainer means horizontal leg portion engaging a bottom surface of the associated decking panel between said slot and the edge of said panel.

* * * * *